United States Patent [19]

Chivens et al.

[11] Patent Number: 4,501,135

[45] Date of Patent: Feb. 26, 1985

[54] STRESS SENSOR FOR YIELD-POINT DETECTION IN A STRETCH PRESS

[75] Inventors: David E. Chivens, Mission Viejo, Calif.; Laramie J. Cloward, Chehalis, Wash.

[73] Assignee: L & F Industries, Huntington Park, Calif.

[21] Appl. No.: 347,305

[22] Filed: Feb. 9, 1982

[51] Int. Cl.[3] ..... B21C 51/00

[52] U.S. Cl. ..... 72/302; 72/31; 72/30; 72/37; 72/296; 356/373

[58] Field of Search ..... 72/301, 302, 296, 295, 72/21, 35, 36, 32, 37, 19, 30, 31; 356/373, 375, 154; 250/561

[56] References Cited

U.S. PATENT DOCUMENTS

| | | | |
|---|---|---|---|
| 2,312,755 | 3/1943 | Dehn | 72/32 |
| 2,945,527 | 7/1960 | Bower et al. | 72/3 |
| 3,077,800 | 2/1963 | Taylor | 72/21 |
| 3,082,809 | 3/1963 | Petsch et al. | 72/302 |
| 3,775,012 | 11/1973 | Ling et al. | 72/35 |
| 4,181,430 | 1/1980 | Shirota et al. | 356/375 |

FOREIGN PATENT DOCUMENTS

| | | | |
|---|---|---|---|
| 999238 | 7/1965 | United Kingdom | 72/35 |

OTHER PUBLICATIONS

Brochure entitled "Position Sensing Photodetectors" from United Detector Technology, Culver City, California.

*Primary Examiner*—Daniel C. Crane

*Attorney, Agent, or Firm*—Christie, Parker & Hale

[57] ABSTRACT

A system for sensing tensile stress in a metal sheet being stretch formed between gripping jaws in a stretch press. Reaction force of the stressed sheet causes elastic deformation of each jaw, and this deformation is detected by movement of a light beam emitted from a source secured to the jaw. A photosensor output signal related to light-beam movement is correlated with a second signal representing sheet strain or elongation to detect when the sheet has been tensioned to the yield point.

7 Claims, 7 Drawing Figures

STRESS SENSOR FOR YIELD-POINT DETECTION IN A STRETCH PRESS

BACKGROUND OF THE INVENTION

Stretch forming is a known process for shaping metal parts by stretching the metal beyond its elastic limit over a die. The sheet is deformed by tension forces into a shape matching that of the die, and the shape is retained due to being imparted when the sheet is stretched beyond its elastic limit. The general process is described in Volume 4 of "Metals Handbook" (8th Edition, 1969, pp. 239–45), and in U.S. Pat. Nos. 2,835,947, 3,073,373, 3,299,688, and 3,575,031, the disclosures of which are incorporated herein by reference.

An important factor in stretch forming is to control the tensile force applied to the sheet to insure that the elastic limit or yield point of the sheet is exceeded when the sheet is formed on the die. Insufficient tensile force prevents permanent deformation of the sheet into a desired shape, because the sheet elastically returns to its original shape when the force is removed. When the yield point is reached, additional force is normally aplied to insure formability of the part, but the resulting additional strain or elongation is carefully controlled to avoid sheet breakage.

A known technique for controlling stretch force is to detect the point at which the relationship between the variables of sheet stress and sheet strain becomes nonlinear. Departure from linearity indicates that the elastic limit or yield point has been exceeded, and that the sheet has been stressed to a point where permanent deformation can be imparted. Typical prior-art control systems are shown in U.S. Pat. Nos. 2,824,594, 2,945,527, and 2,999,528, the disclosures of which are incorporated herein by reference.

Sheet strain is typically measured by monitoring the positions of a pair of hydraulically actuated opposed jaws which grip the sheet and apply the stretching force. Alternatively, this measurement could be made on the sheet itself by conventional strain gages or similar transducers. This invention is not directed to sheet-strain measurement, but rather to an indirect method for measuring stress in the sheet by measuring elastic deformation of the jaw.

Stretch-press jaws are relatively massive structures with movable surfaces which are typically hydraulically driven to effect a tight clamping grip on opposite ends of the sheet to be formed. The entire jaw assemblies are in turn movable either linearly or in rotation with respect to each other to elongate and tension the sheet. In spite of the massive construction of the jaw assemblies, a small elastic deformation of each assembly arises from the reaction force of the tensioned sheet on the jaws.

In the practice of the invention, this elastic deformation of the jaw assembly is sensed optically by measuring the movement of a sharply focused light beam emitted from a source secured to the jaw assembly. Use of a photoelectric transducer enables light-beam movement to be converted to an electrical signal for comparison to a second and separately generated signal representing strain in the sheet.

SUMMARY OF THE INVENTION

Briefly stated, this invention relates to a sheet-stress sensor for use in combination with a stretch press having a base, and an elongated gripping-jaw assembly supported on the base and adapted to grip a part such as a metal sheet to be stretch formed by the press. The sensor includes a light source for projecting a light beam along the jaw assembly. The source is rigidly fastened to the jaw assembly, whereby the beam is deflected as the jaw assembly is elastically deflected or deformed by reaction force of the sheet during stretch forming. A means for monitoring deflection of the beam, and for generating a signal related to beam position, is preferably also secured to the jaw assembly. Deflection of the beam arising from deformation of the jaw assembly is sensed by the monitoring means which provides a signal analogous to tensile stress in the sheet.

Preferably, the light source is a laser which provides a highly collimated narrow light beam which is focused in an elongated line by a cylindrical lens. To lengthen the optical lever arm of the system, a mirror is preferably positioned at an end of the jaw assembly to a photodiode beam-position sensor which is spaced from but adjacent the laser. The output signal of the photodiode is compared to a second signal representing strain or elongation of the sheet, and the yield point of the stretched sheet material is sensed when the relationship between these two variables becomes nonlinear.

DESCRIPTION OF THE PREFERRED EMBODIMENT

Figure 1:
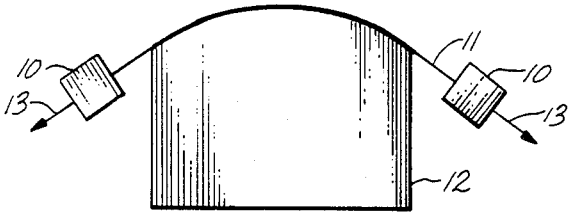
FIG. 1 is an elevation of a greatly simplified stretch press.

FIG. 1 is a simplified diagramatic view of a stretch press having a pair of jaws 10 gripping the opposite ends of a metal sheet 11 to be stretch formed over the convex upper surface of a die 12. In operation, mechanical actuators such as large hydraulic cylinders (not shown) move the jaws away from each other as indicated by arrows 13. The resulting elongation of the sheet is continued until the sheet is stretched beyond its yield point. The sheet is then in a semiplastic condition which enables it to deform permanently in conformance with the contour of the die. A variety of other sophisticated forming operations may be performed on the sheet when it is in the stretched condition, but such techniques are well-known in the art and, for brevity, will not be described in detail.

Figure 2:
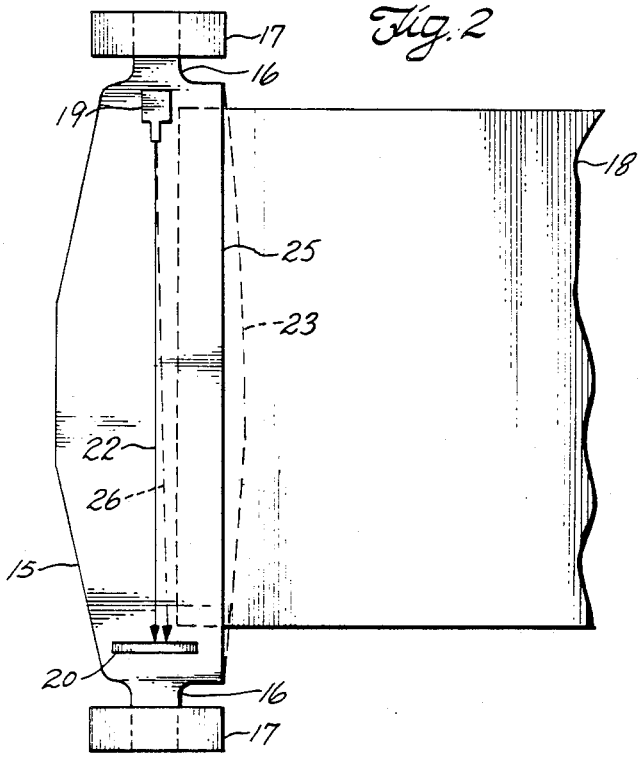
FIG. 2 is a plan view of simplified jaw assembly as used in a stretch press.

FIG. 2 is a greatly simplified plan view of a jaw assembly 15 supported by trunnions 16 journaled through vertical frame members 17 which are in turn mounted on a base of the stretch-forming machine. Depending upon the style of the machine, the jaw assembly may be rotatable with respect to the frame to achieve sheet elongation, or the jaw assembly may be moved linearly with respect to the base to achieve elongation of a sheet 18 clamped in the jaw assembly. A sharply focused light source 19 is rigidly secured adjacent one end of the elongated jaw assembly, and a beam-position sensor 20 (which, in a rudimentary form, could simply be a scale) is rigidly secured to the other end of the assembly.

Solid arrow 22 shows the path of the beam when the sheet is in an unstressed condition prior to application of stretching force. When the jaw assemblies are moved apart to elongate the sheet, the reaction force of the stressed sheet causes a slight elastic deformation of the jaw assembly with respect to its original unstressed condition. This deformation is shown in exaggerated fashion by dashed line 23 which illustrates the stressed position of a front surface 25 of the jaw assembly. As a result of this deformation, the light beam projected by source 19 moves with respect to sensor 20 to a new position as suggested by dashed arrow 26. Beam deflection is directly related to sheet stress which is the variable to be measured.

Figure 3:
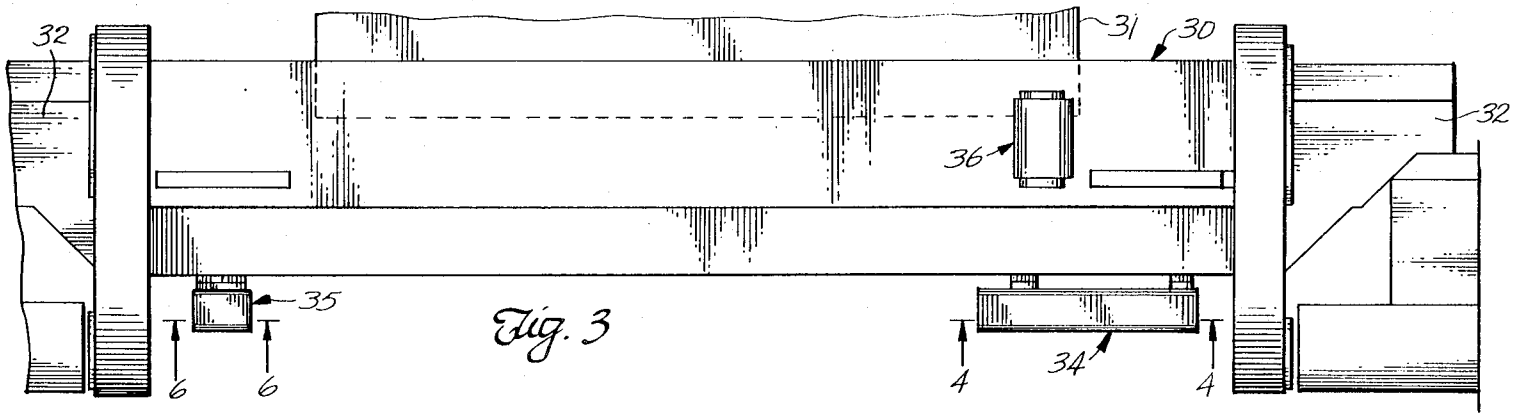
FIG. 3 is another plan view of a typical stretch-press jaw assembly on which are mounted the several components of the stress sensor of this invention.

A presently preferred embodiment of the invention is shown in FIGS. 3–7. FIG. 3 is a simplified plan view of a jaw assembly 30 having clamping surfaces (not shown) tightly engaged with a sheet 31 to be stretch formed. The jaw assembly is supported with each end by frame members 32 which are in turn mounted on a base (not shown) of the machine.

Rigidly secured at one end of the jaw assembly is a source and sensor housing 34. A mirror housing 35 is rigidly secured adjacent the opposite end of the jaw assembly. These components are preferably mounted on a rear surface of the jaw opposite the sheet, as this places the housings in a relatively protected position which does not interfere with the moving parts of the machine during stretch forming. An electrical housing 36 may be positioned on the top of the jaw assembly adjacent the source and sensor housing, and the electrical housing contains appropriate power supplies and other electronic equipment for the light source and sensor.

Figure 4:
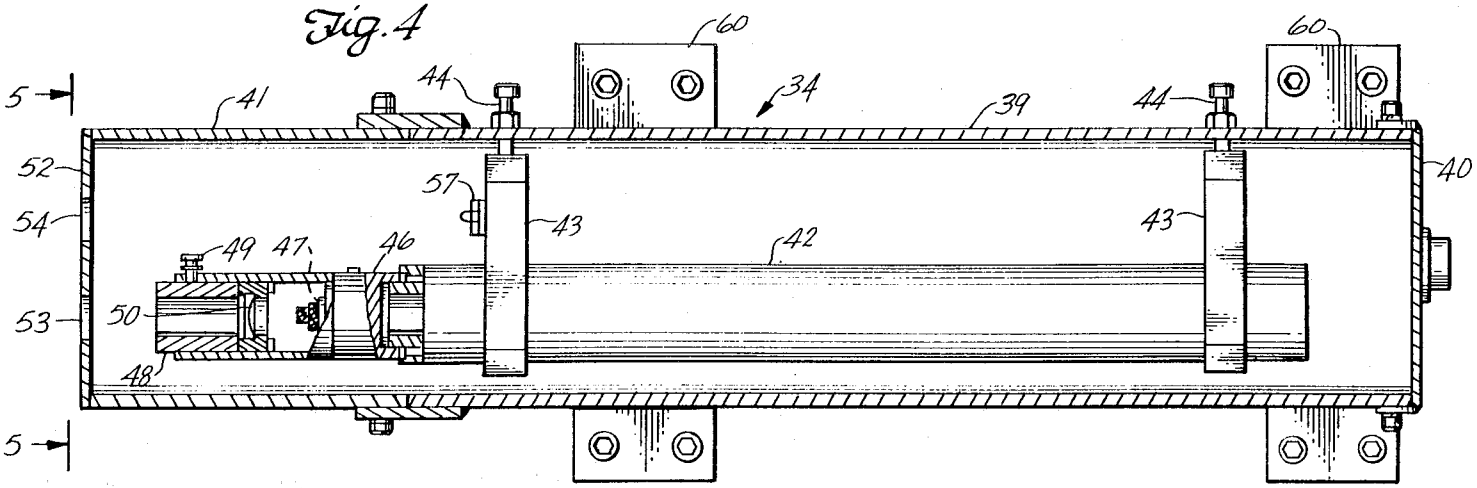
FIG. 4 is a sectional elevation of a source and sensor housing on line 4—4 of FIG. 3.
Figure 5:
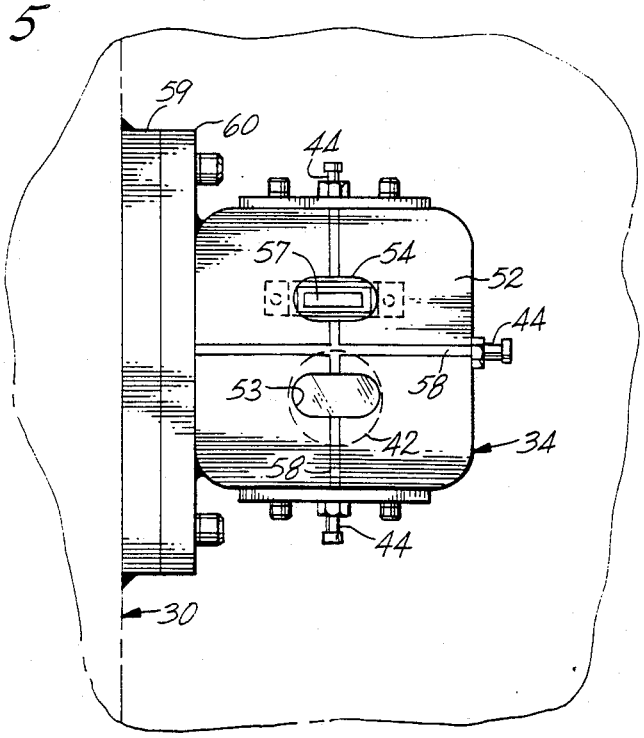
FIG. 5 is an end view, partially broken away, on line 5—5 of FIG. 4.

Housing 34 is shown in greater detail in FIGS. 4 and 5, and the housing includes a main body tube 39 which is enclosed by a rear end plate 40 and a removable front cap 41. A preferred light source is a laser 42 (a Hughes Type 3024H is suitable) supported within the housing by a pair of longtudinally spaced clamping blocks 43 secured to the housing by adjustable positioning screws 44.

A tubular barrel 46 is secured to the forward or output end of the laser, and a conventional spacial lens 47 is mounted within the barrel. A tube 48 makes a telescoping slip fit within the forward end of barrel 46, and is adjustable in longitudinal position with respect to the barrel by loosening a clamping screw 49. A cylindrical lens 50 is supported within the rear end of tube 48, and the function of this lens is to convert the narrow light beam emitted by the laser to a horizontally narrow and vertically elongated beam.

As shown in FIG. 5, a front plate 52 of cap 41 has a racetrack-shaped opening 53 for the light beam from the laser. Positioned above opening 53 is a second and similarly shaped opening 54 to admit the return beam as reflected from mirror housing 35.

A single-axis position-sensing photodiode 57 is secured to the front surface of forward clamping block 43 in alignment with opening 54 to receive the reflected laser beam. Photodiode 57 senses linear movement of the light beam, and generates an electrical signal representing the position of the light beam along the horizontally elongated sensitive surface of the photodiode. A suitable photodiode sensor is a type PIN-LSC/30D as manufactured by United Detector Technology of Culver City, Calif.

Preferably, an alignment crosshair reticle 58 is scribed or painted on the front surface of plate 52 to assist in preliminary alignment of the optical system. Housing 34 and its associated components are secured to jaw assembly 30 by plates 59 welded to the jaw assembly, and a pair of mounting brackets 60 welded to the housing and bolted to plate 59.

Figure 7:
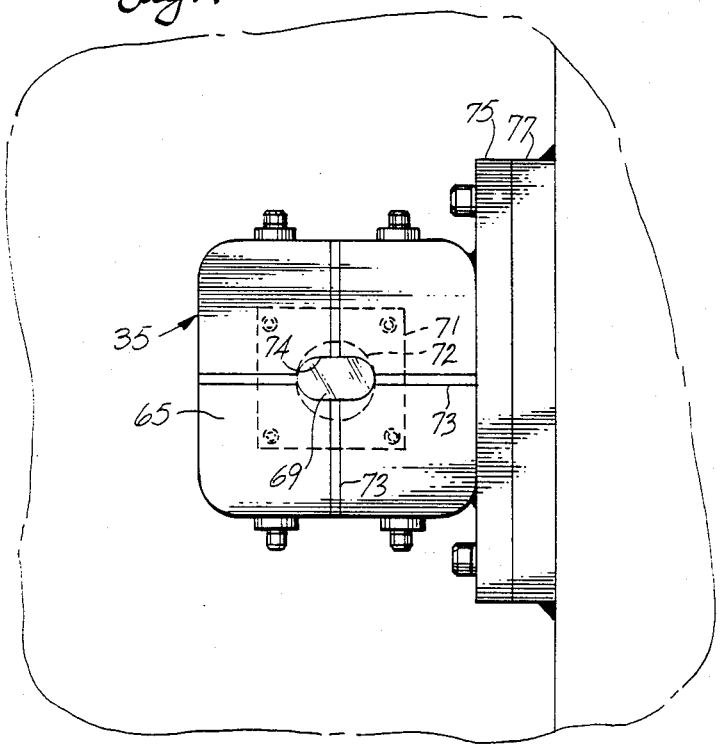
FIG. 7 is an end view on line 7—7 of FIG. 6.
Figure 6:
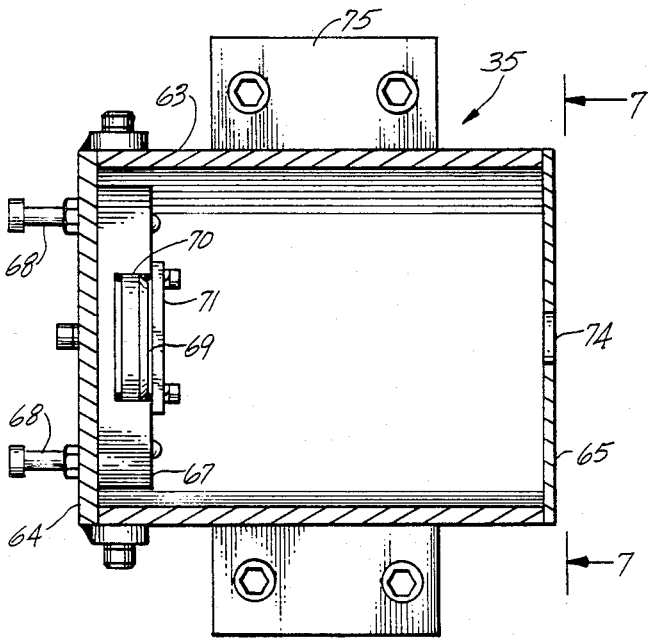
FIG. 6 is a sectional elevation of a mirror housing on line 6—6 of FIG. 3.

Mirror housing 35 is shown in greater detail in FIGS. 6 and 7, and includes a main body tube 63 closed at one end by a rear end plate 64 and at the other end by a front end plate 65. A mirror mounting block 67 is adjustably positioned by a plurality of mounting screws 68 against the inner surface of rear end plate 64. A front-surfaced planar mirror 69 is secured within a recess 70 in mounting block 67 by a retaining plate 71 having a central circular opening 72 (FIG. 7).

The front plate of the mirror housing is scribed or painted with a crosshair reticle 73 useful during preliminary focusing and alignment of laser 42. The front plate is centrally apertured with a racetrack-shaped opening 74 to pass the incoming and reflected laser beam. Housing 35 is welded to a mounting bracket 75 bolted to a pad or plate 77 which is in turn welded to the jaw assembly.

Electrical housing 36 is also bolted to the jaw assembly, and a conventional power supply for laser 42 is secured within and protected by this housing. Also positioned within the electrical housing is a conventional signal-conditioning circuit to drive and receive an output signal from photodiode 57, and to amplify the signal to a suitable level for use in a stress-strain comparison circuit.

Initial optical alignment of the system requires adjustment of the laser clamping blocks to insure that the vertical-line laser beam is projected through opening 74 in the mirror housing, and reflected by mirror 69 back through this opening toward the source and sensor housing. The mirror mounting block is then adjusted in position to direct the reflected beam through opening 54 in front plate 52 to fall slightly to one side (the unstressed position) of the center line of the rectangular sensitive surface of photodiode 57.

When the stretch press is in operation, and the jaw assembly is applying a tension force to a clamped metal sheet, the jaw assembly elastically deforms or deflects in response to the reaction force exerted by the sheet as previously discussed in connection with FIG. 2. Source and sensor housing 34, which is rigidly secured to the jaw assembly, is rotated slightly (about an axis normal to the stretched sheet) by this distortion of the jaw assembly, and the laser beam is accordingly deflected along mirror 69. The reflected beam is similarly deflected (at double amplitude) along the sensitive surface of photodiode 57 which generates a signal proportional to deflection and hence to sheet stress.

If desired, the mirror housing can be eliminated, and the photodiode positioned in its place, but reflection of the laser beam is generally preferred as a way of amplifying the relatively minute deflection of the laser beam caused by elastic distortion of the jaw assembly. In a typical reflected-beam system, a beam deflection of about one-fourth inch (at the photodiode) is readily achieved between the unstressed condition of the sheet, and the tensioned condition at the yield point. The position-sensing photodiode is adequately sensitive to generate a useful signal at these deflection levels.

As briefly discussed above, the amplified signal from the photodiode is compared in conventional circuitry (not shown) to a second electrical signal representing strain or elongation of the tensioned sheet. The relationship between these two variables remains linear until the yield point or elastic limit of the sheet is reached. The relationship between the variables thereafter becomes nonlinear, with sheet strain increasing at a more rapid rate than sheet stress. This transition point is readily sensed electronically, and is used to initiate the next operation in an automatic cycle, or to alert the operator that only a limited amount of additional force should be applied to achieve proper stretch forming without risk of exceeding the ultimate strength of the sheet.

Although the laser is preferred as a source of a highly collimated light beam, other illumination sources such as incandescent lamps with suitable focusing lenses can also be used. Similarly, the invention is not restricted to use of a photodiode beam-position sensor, but the phototdiode transducer is relatively economical and reliable, and provides a satisfactory output signal which is easily processed for comparison with the strain signal.

Similarly, the invention is not restricted to any particular style of stretch press, and is equally usable on presses having either rotatable or linearly movable jaw assemblies for elongating the metal sheet. Even a very massive jaw assembly will elastically deform or deflect slightly in response to the reaction force of the heavily tensioned sheet, and this distortion causes a slight movement of the light beam which is optically amplified by the relatively long "lever arm" between the light source and beam-position sensor.

What is claimed is:

1. In combination with a stretch press having a base, and an elongated gripping-jaw assembly having a frame supported on the base, the assembly being adapted to grip a metal part to be stretch formed by the press, an improved sensor for monitoring tensile stress in the part during stretch forming, the sensor comprising:

a light source for projecting a light beam along the jaw assembly, the source being rigidly secured to the jaw assembly so the beam is deflected as the jaw assembly is elastically deformed by reaction force of the part during stretch forming; and means secured to the jaw assembly for monitoring deflection of the beam, and for generating a signal related to beam position and hence to tensile stress in the part, the signal being comparable to a second signal related to part strain whereby a stress-strain relationship in the part can be monitored during stretch forming.

2. The combination defined in claim 1 wherein the light source is a laser.

3. The combination defined in claim 2 and further comprising a cylindrical lens positioned in the laser beam to elongate the beam.

4. The combination defined in claim 2 wherein the monitoring means is a photodiode secured to the jaw assembly.

5. The combination defined in claim 2, and further comprising a mirror secured to the jaw assembly and to receive and reflect the laser beam toward the monitoring means.

6. The combination defined in claim 5 wherein the laser and mirror are mounted adjacent opposite ends of the jaw assembly, and the monitoring means is mounted adjacent the laser.

7. The combination of claim 6 wherein the monitoring means is a photodiode, and further comprising a cylindrical lens positioned in the laser beam to elongate the beam.

* * * * *